US005608945A

United States Patent [19]

Crouser et al.

[11] Patent Number: 5,608,945

[45] Date of Patent: Mar. 11, 1997

[54] WET/DRY UTILITY VACUUM CLEANER

[75] Inventors: Darwin S. Crouser, Canton; Nick M. Bosyj, North Canton; Donald R. Bowers; Nicholas Koukourakis, both of Akron; Richard A. Wareham; Conway Vincent, both of North Canton, all of Ohio

[73] Assignee: The Hoover Company, North Canton, Ohio

[21] Appl. No.: 498,394

[22] Filed: Jul. 5, 1995

Related U.S. Application Data

[62] Division of Ser. No. 7,982, Jan. 15, 1993, Pat. No. 5,455, 983.

[51] Int. Cl.[6] ..... A47L 7/00

[52] U.S. Cl. ..... 15/328; 15/352; 15/353

[58] Field of Search ..... 15/328, 331, 352, 15/353, 320

[56] References Cited

U.S. PATENT DOCUMENTS

| | | | |
|---|---|---|---|
| 2,499,876 | 3/1950 | Platek | 15/353 |
| 2,528,375 | 10/1950 | Lilly | 15/353 X |
| 2,657,416 | 11/1953 | Smith | 15/331 |
| 3,029,461 | 4/1962 | Osborn | 15/320 |
| 3,034,273 | 5/1962 | Wallace | 15/320 X |
| 3,040,363 | 6/1962 | Krammes et al. | 15/320 |
| 3,552,100 | 1/1971 | Ekenberg | 55/337 |
| 3,616,482 | 11/1971 | Brycki | 15/353 |
| 4,138,761 | 2/1979 | Nauta | 15/353 |
| 4,194,262 | 3/1980 | Finley et al. | 15/314 |
| 4,216,563 | 8/1980 | Cyphert | 15/353 |
| 4,845,793 | 7/1989 | Meyer | 15/328 |
| 4,951,346 | 8/1990 | Salmon | 15/322 |
| 4,977,638 | 12/1990 | Best | 15/301 |
| 5,012,549 | 5/1991 | Williams et al. | 15/353 |

*Primary Examiner*—Chris K. Moore

*Attorney, Agent, or Firm*—Renner, Kenner, Greive, Bobak, Taylor & Weber

[57] ABSTRACT

The present invention teaches a utility, wet/dry, tank type, vacuum cleaner suitable for domestic use whereby wet or dry material may be alternately vacuumed. Two storage or receiving chambers are provided, preferably positioned one within the other. Two suction inlets, one communicating with the first chamber and the other communicating with the second chamber are provided such that wet and dry material may be selectively directed, by the user, to the appropriate chamber for collection.

23 Claims, 12 Drawing Sheets

90
88
86
36
35
23

5
5
24
25
25
23
35
37
20
10
2
2
4
11
4

WET/DRY UTILITY VACUUM CLEANER

This application is a division of application Ser. No. 08/007,982, filed Jan. 15, 1993 now U.S. Pat. No. 5,455,983 issued Oct. 10, 1995.

BACKGROUND OF THE INVENTION

The present invention relates to a utility vacuum cleaner of the tank type typically used for wet or dry pickup. Heretofore tank type wet/dry vacuum cleaners have been provided with one debris receiving chamber; such units are generally configured, by the user, for either wet or dry pickup by removal or insertion of a dust collecting filter upstream of the suction fan such as taught in U.S. Pat. No. 4,138,761. Still other wet/dry units, permitting wet or dry pickup, have been provided wherein the tank receives and retains liquid matter during wet pickup and during dry pickup, dry dust debris passes through the wet tank plenum, into and through the suction fan and is collected within an external filter bag downstream of the suction fan as taught in U.S. Pat. No. 3,552,100.

The disadvantages of the above referred prior art wet/dry cleaners is obvious. The first described unit is used in either the wet mode or dry mode and is not intended for alternating wet or dry pickup without unit modification. The user is advised to reconfigure the unit when changing from one mode to the other. The second referenced unit, when operating in the dry mode, permits fallout of dry debris into the liquid retained within the liquid receiving chamber thereby creating a potential for the formation of a sludge type mixture within the liquid receiving tank.

SUMMARY OF THE PRESENT INVENTION

By the present invention a wet/dry tank type vacuum cleaner is disclosed having two separate and distinct, internal receiving chambers or tanks. One tank exclusively receives and retains wet material and a second tank exclusively receives and retains dry debris. Two parallel suction inlets are provided. A first inlet delivers wet material directly into the wet receiving tank while the second inlet delivers dry debris laden air directly into the dry tank. The operator/user selectively chooses the wet inlet or dry inlet depending upon the material being vacuumed.

The dry tank is preferably positioned within the wet tank and removable for ease in emptying. Also by removal of the dry tank the entire volumetric capacity of the cleaner (wet plus dry) may be converted, if desired, for wet only or dry only collection.

The preferred embodiment, as taught herein, features dual suction inlets. One inlet communicating directly with the dry chamber, the other communicating with the wet chamber. A shuttle valve door is selectively positioned, by the user, in sealing contact with the suction inlet not in use. Thus the user selects the wet or dry mode depending upon the material to be vacuumed. Although dual suction inlets are disclosed herein as the preferred embodiment, a single inlet having a diverter valve, selectively positioned by the user, may be alternately provided whereby the material being vacuumed may be selectively directed to the wet or dry chamber as desired. Such an alternate embodiment is also taught.

DESCRIPTION OF THE PREFERRED EMBODIMENT

Figure 1:
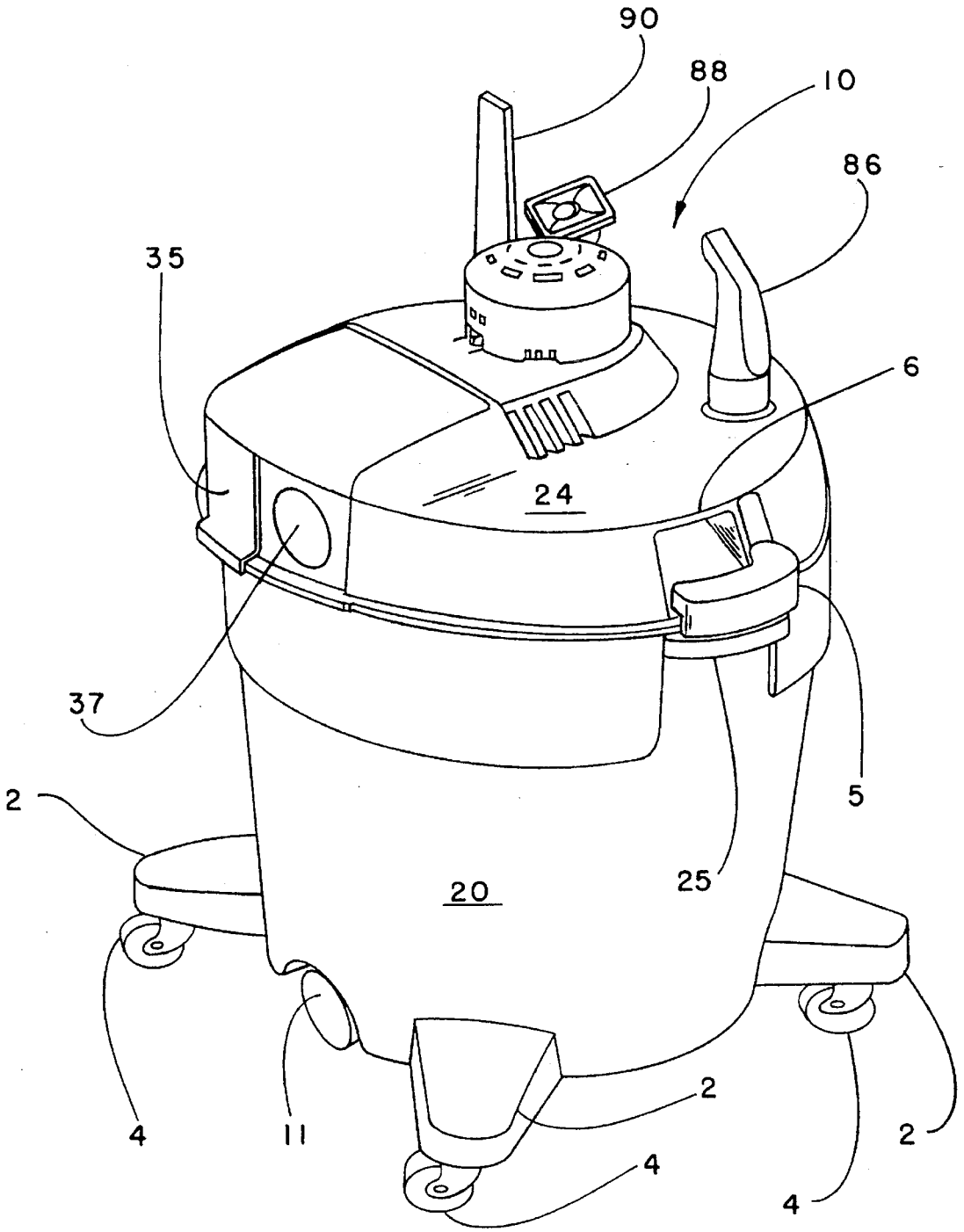
FIG. 1 is a perspective view of a tank type vacuum cleaner embodying the present invention.
Figures 2, 2A:
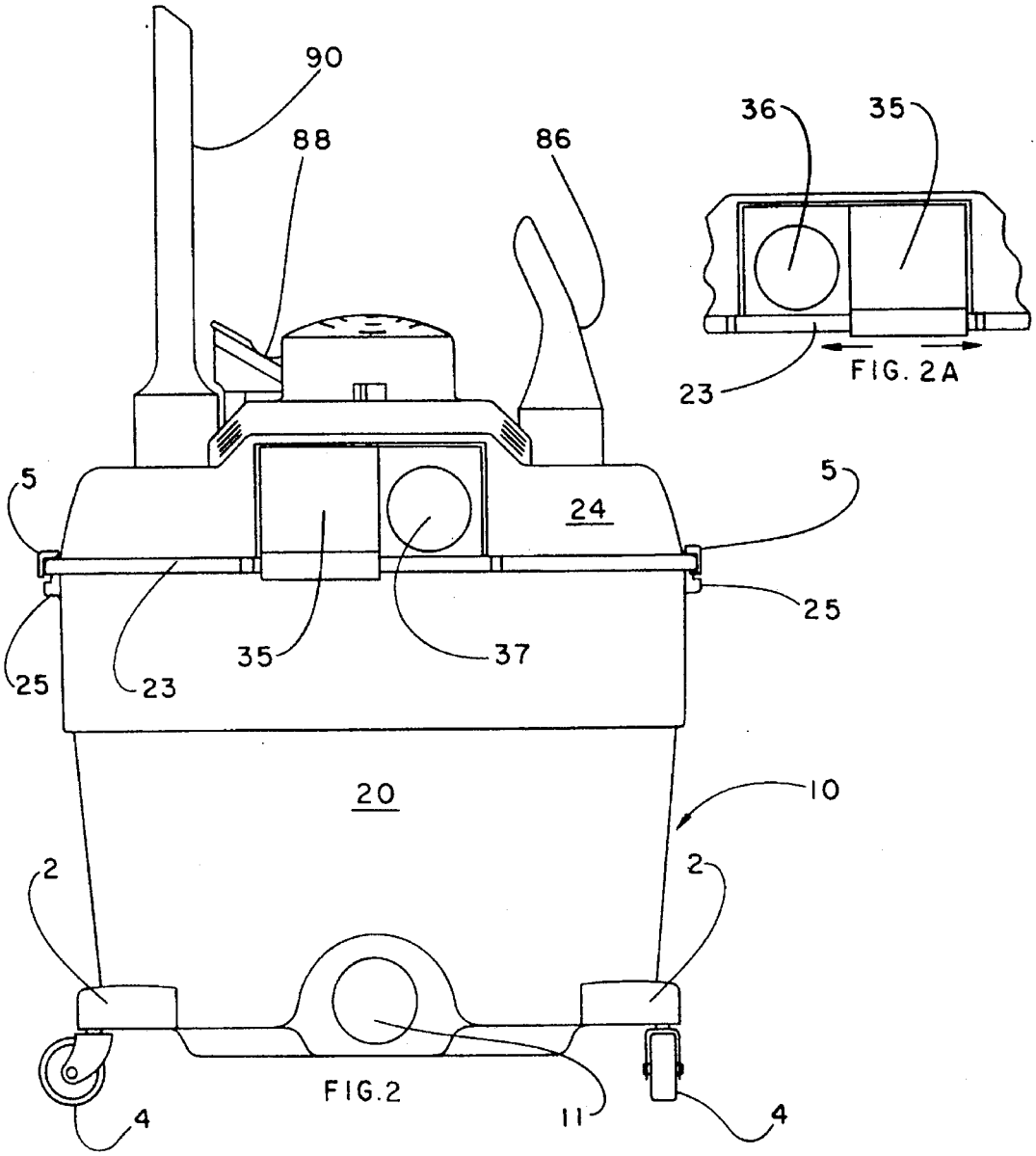
FIG. 2 is a front elevational view of the tank type vacuum cleaner shown in FIG. 1 with the valve door in the dry vacuuming mode.
FIG. 2A presents a partial elevational view of the valve door showing the valve door in the wet vacuuming mode.
Figure 3:
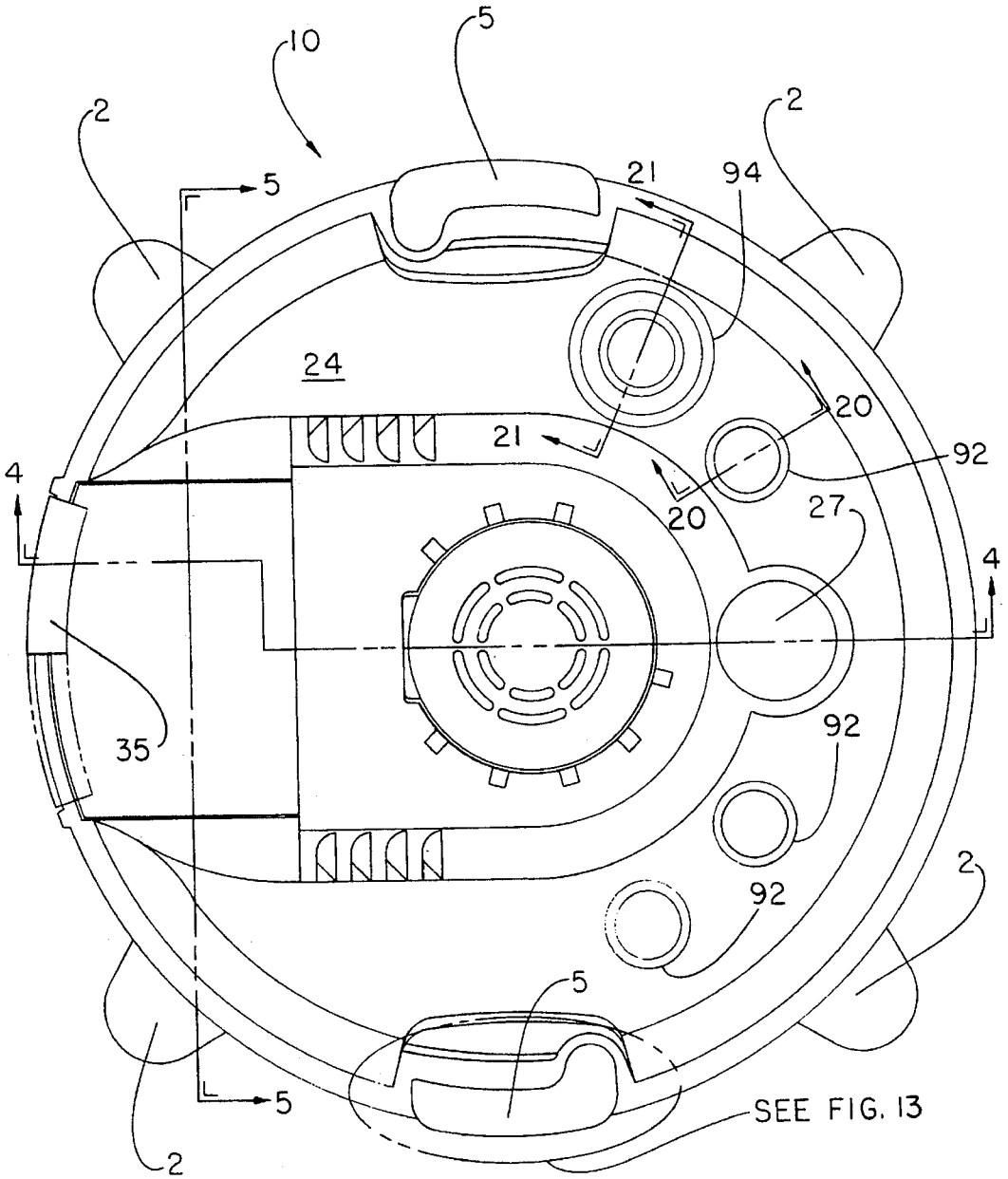
FIG. 3 is a top view of the tank type vacuum cleaner shown in FIG. 1 with vacuum accessories removed.

Referring to FIGS. 1 through 3, a wet/dry vacuum cleaner 10, of the utility tank type, is shown. Cleaner 10 typically comprises a bottom tank 20 and a power head or cover lid 24 removably and sealingly attached to bottom tank 20. Cover lid 24 is preferably affixed to tank 20 by two diametrically opposed latches 5. Tank 20 is typically supported upon four outrigger caster supports 2 having full swiveling castered wheels attached thereto.

Figure 4:
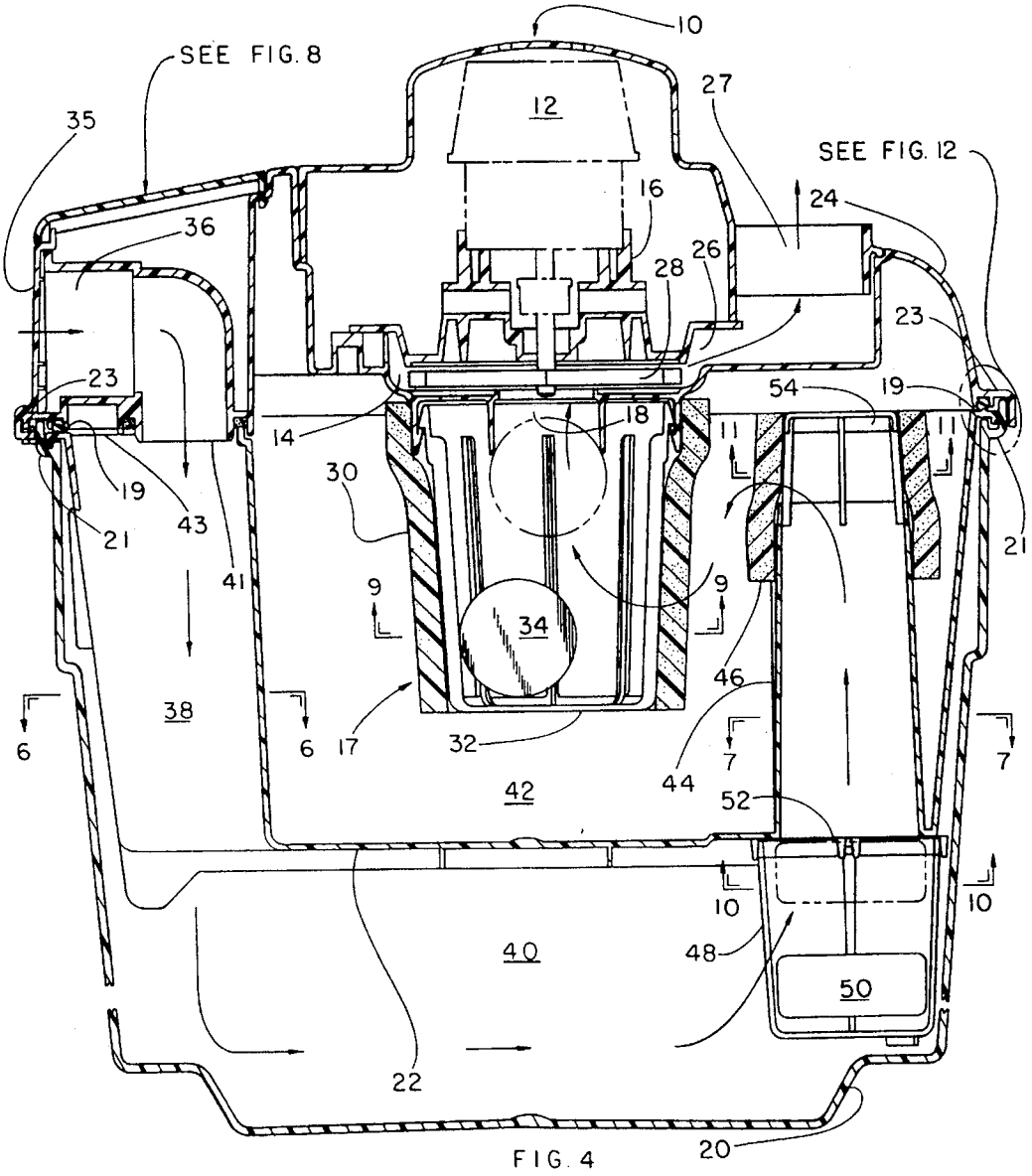
FIG. 4 is a cross-sectional view taken along line 4—4 of FIG. 3.
Figure 5:
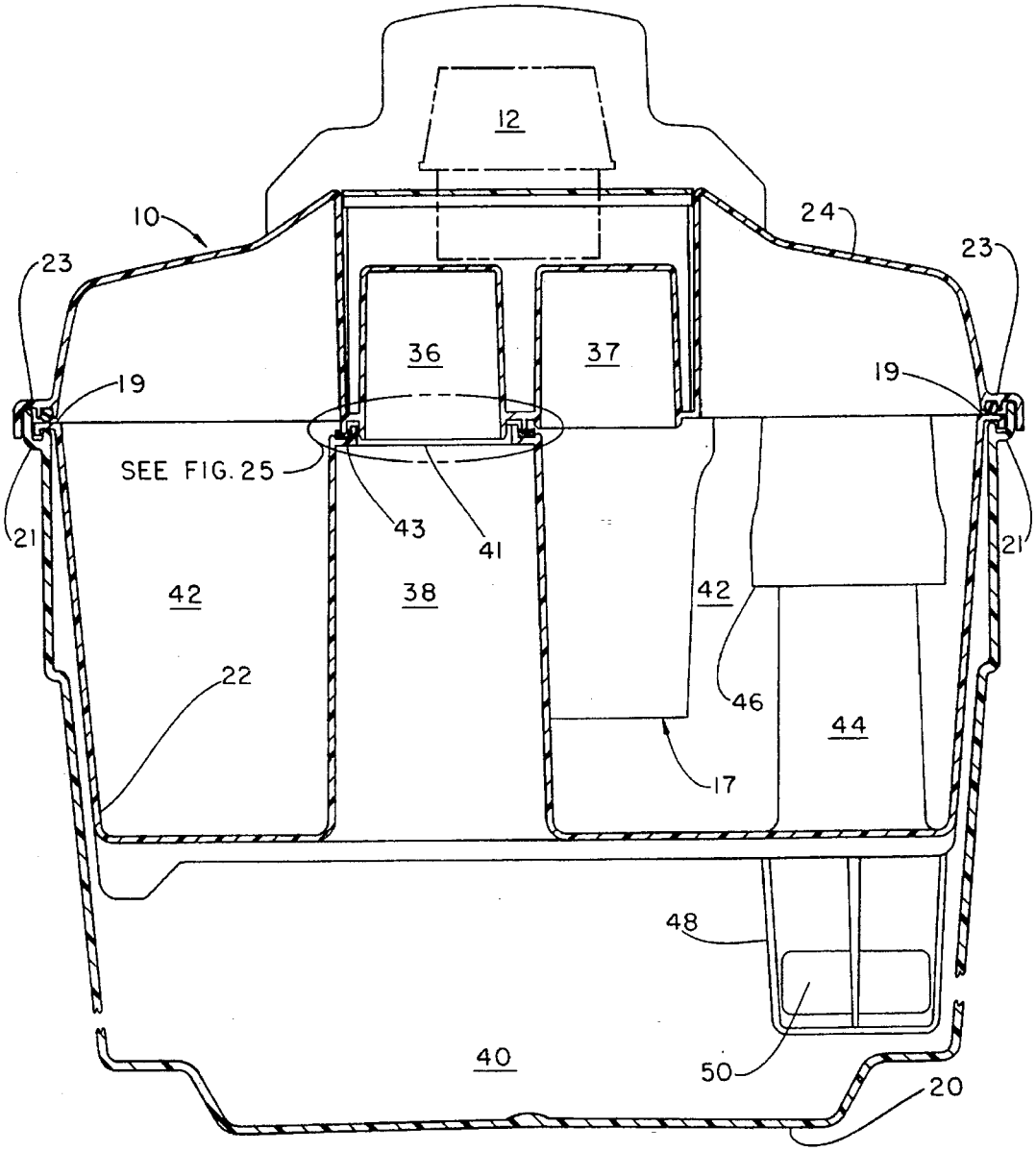
FIG. 5 is a cross-sectional view taken along line 5—5 of FIG. 3.
Figure 20:
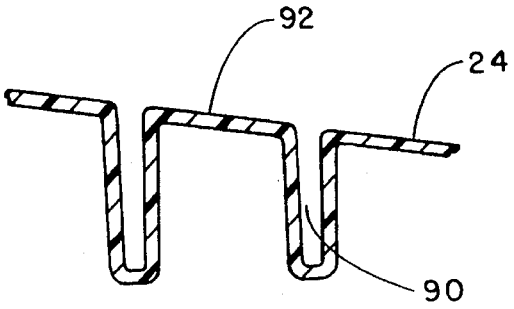
FIG. 20 is a cross-sectional view taken along line 20—20 of FIG. 3.
Figure 21:
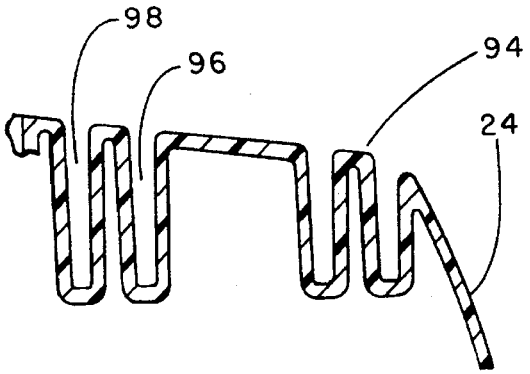
FIG. 21 is a cross-sectional view taken along line 21—21 of FIG. 3.
Figure 6:
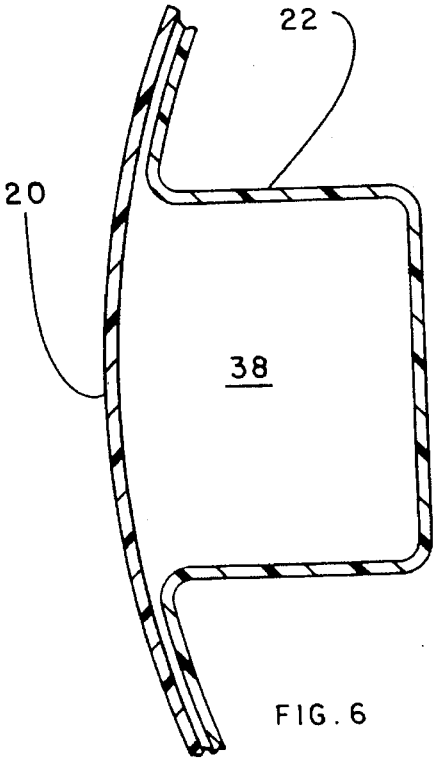
FIG. 6 is a cross-sectional view taken along line 6—6 of FIG. 4.
Figure 7:
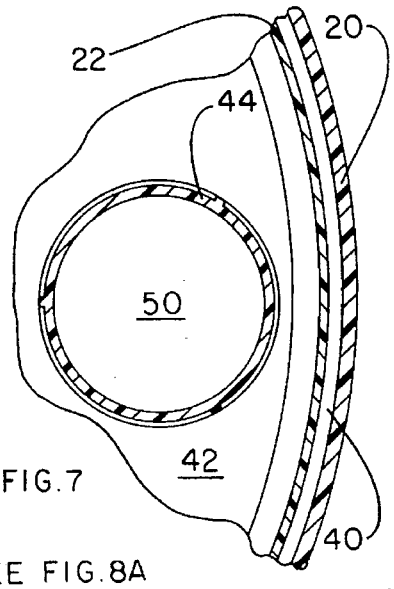
FIG. 7 is a cross-sectional view taken along line 7—7 of FIG. 4.
Figure 12:
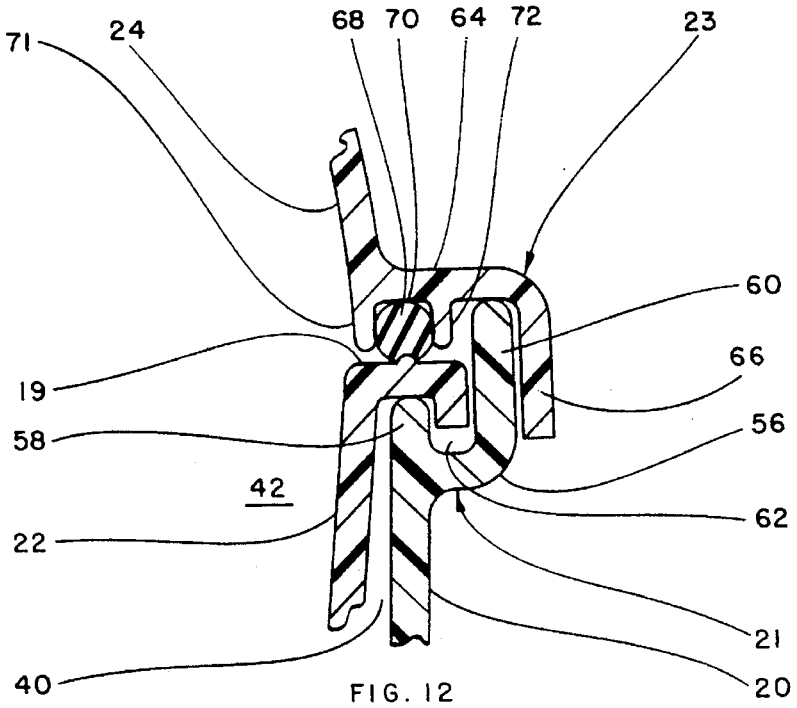
FIG. 12 is a partial and enlarged cross-sectional view showing the lid to tank seal as indicated in FIG. 4.

Referring further to FIGS. 4 and 5, telescopingly received within bottom tank 20 is inner tank 22 sealingly supported upon rim 21 of tank 20. Cover lid or power head 24 includes circumferential rim 23 which sealingly engages rim 19 of inner tank 22 and rim 21 of outer tank 20 as best illustrated in FIG. 12. The combination of bottom tank 20, inner tank 22 and lid 24 define two separate debris receiving chambers 40 and 42 within cleaner 10. Tank 22 is telescopingly received within tank 20 as seen in FIGS. 4 and 5. As can be readily observed the relative capacity of tank 40 with respect to tank 42 may be varied by extension or reduction of the respective tank side wall height. It is preferred that tank 20 receive and exclusively collect wet debris and vacuumed liquids; inner tank 22 is thereby intended for receipt of and exclusive collection therein of dry debris. The means for selectively directing wet and dry debris to tank 20 and 22 respectively is further discussed below.

Referring now to FIGS. 2, 4, 5, 6, and 7. Removable inner tank 22 incorporates a vertical inlet bypass 38 communicating with chamber 40 of wet tank 20, and exhaust tower 44 provides fluid communication between wet chamber 40 of tank 20 and dry chamber 42 of tank 22. Incorporated within cover 24 are two separate inlet ports 36 and 37. Inlet port 36 is intended for wet debris pickup and fluidly communicates directly with inlet bypass 38 thereby providing direct access to wet chamber 40 of tank 20. Inlet port 37, on the other hand, communicates directly with dry chamber 42 of dry tank 22.

Figure 25:
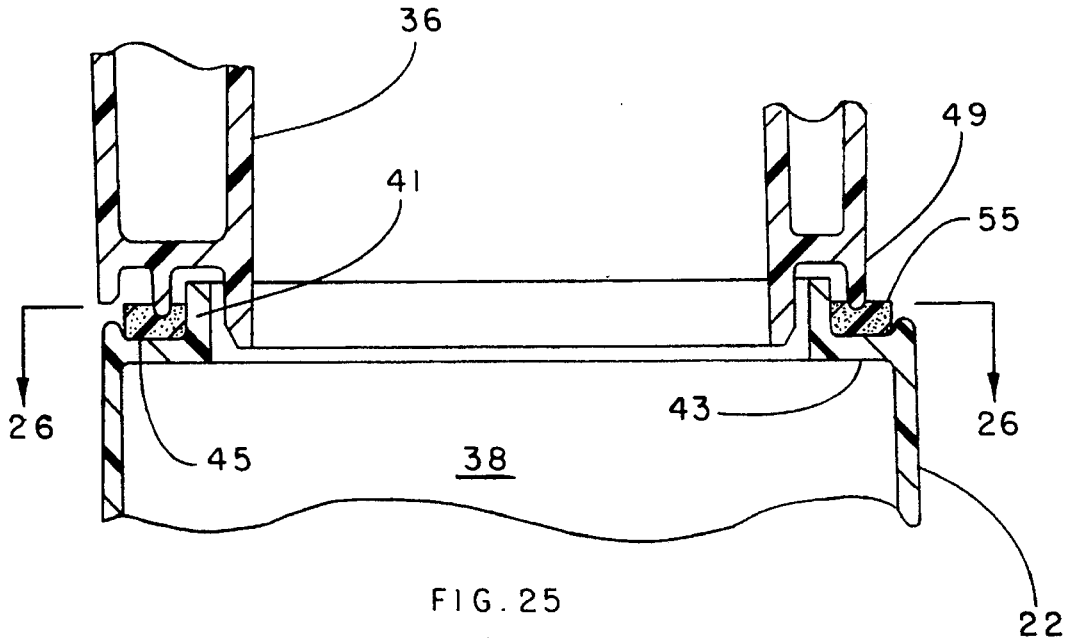
FIG. 25 is an enlarged cross-sectional view of the wet inlet port seal as indicated in FIG. 5.
Figure 26:
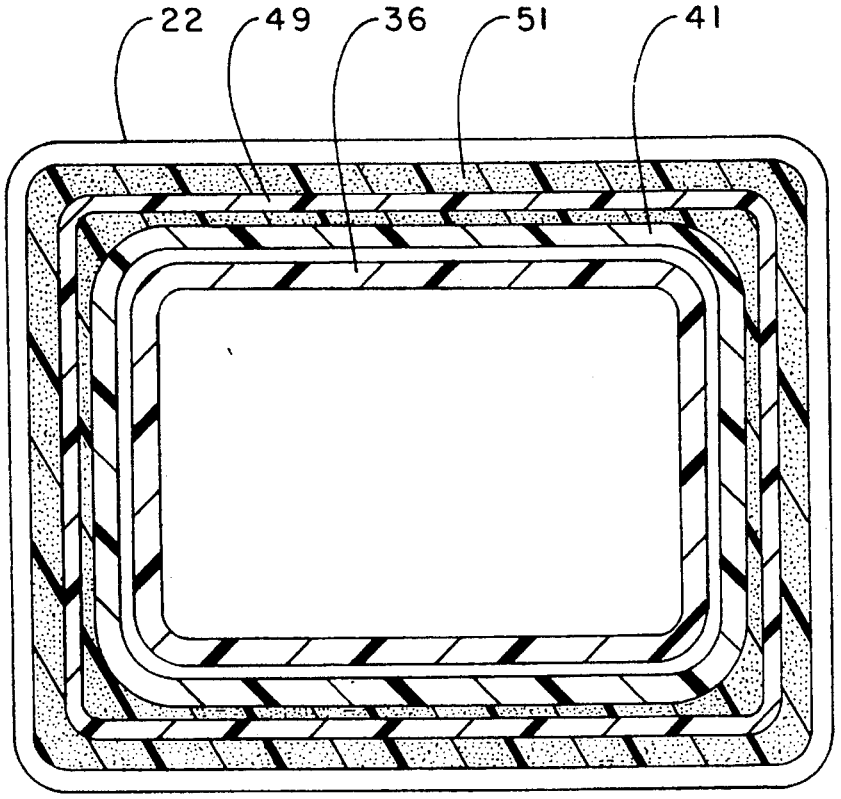
FIG. 26 is a cross-sectional view taken along line 26—26 of FIG. 25.

Wet inlet port 36 is sealingly received within rectangular aperture 41 of integrally molded top cover 43 of by-pass 38. As best seen in FIG. 25 and FIG. 26, aperture 41 is circumscribed by a seal receiving groove 45 having positioned therein a suitable elastomeric seal 55. Inlet port 36 is provided a circumscribing downwardly extending sealing rib 55 that when top cover 24 is placed upon bottom tank 20, rib 49 sealingly engages seal 55 slightly compressing seal 55 between groove 45 and rib 49 thereby affecting an airtight seal between inlet port 36 and by-pass 38.

Sliding valve door 35 freely translates left or right, as shown in FIG. 2 and 2A, thereby selectively sealing off inlet 36 or 37 as desired When dry debris is being vacuumed door 35 is positioned to the left as seen in FIG. 2 and a suitable vacuum hose (not shown) is inserted into inlet port 37. Similarly when it is desired to vacuum wet debris, door 35 is positioned to the right, as shown in FIG. 2A, exposing wet inlet port 36 for vacuum hose insertion.

Figure 8A:
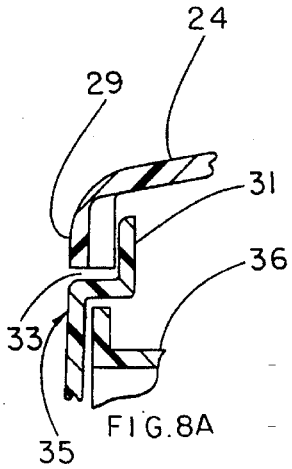
FIG. 8A is a partial and enlarged cross-sectional view showing the upper valve door attachment structure as indicated in FIG. 8.
Figure 8:
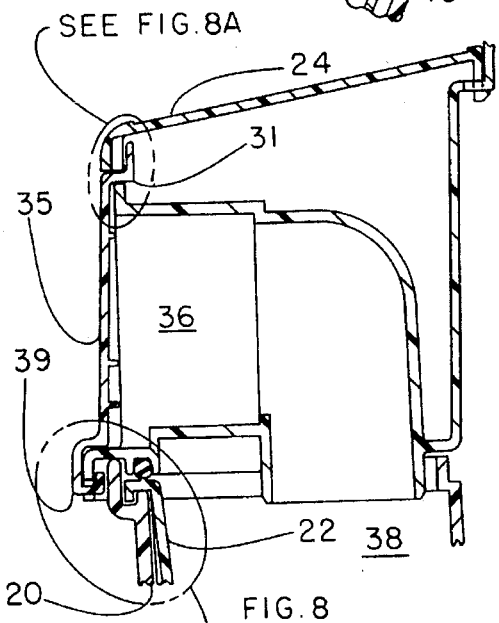
FIG. 8 is a partial and enlarged cross-sectional view showing the sliding valve door structure as indicated in FIG. 4.
Figure 8B:
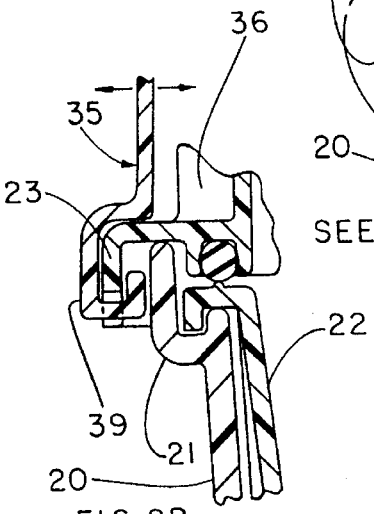
FIG. 8B is a partial and enlarged cross-sectional view showing the lower valve door attachment structure as indicated in FIG. 8.

Referring to FIGS. 8, 8A, and 8B the valving operation of valve door 35 will be described. Valve door 35, at the top thereof, is provided with an offset lip 31 extending through gap 33 between upper guide rail 29 of lid 24 and inlet port 36 and upward along the inside surface of guide rail 29 as illustrated in FIG. 8A. Valve door 35 is further provided, at the bottom thereof, "J" hook 39 which engages the downturned rim 23 of lid 24 as shown in FIG. 8B. It is to be noted that offset lip 31 and "J" hook 39 loosely engage guide rail 29 and rim 24, respectively, such that door 35 may move slightly inward and/or outward, as shown by the arrows in FIG. 8B, thereby permitting valve door 35 to be vacuum drawn against the selected inlet port 36 or 37 thus sealing off the selected port from the atmosphere and permitting vacuumed airflow exclusively through the open inlet port.

Figure 9:
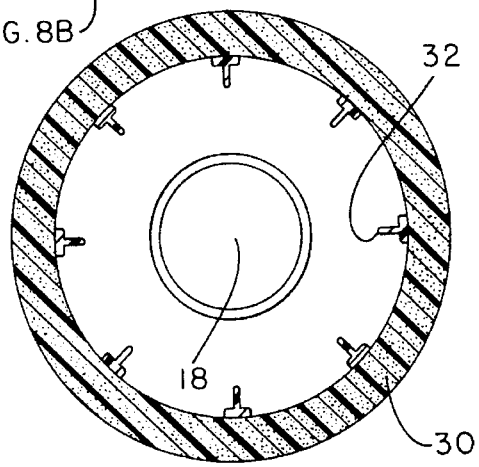
FIG. 9 is a cross-sectional view taken along line 9—9 of FIG. 4.
Figure 10:
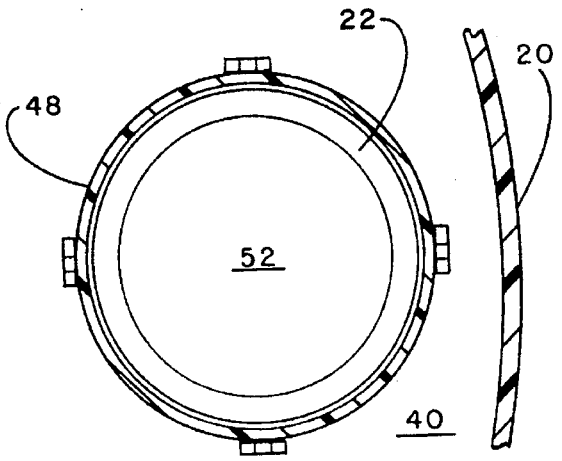
FIG. 10 is a cross-sectional view taken along line 10—10 of FIG. 4.
Figure 11:
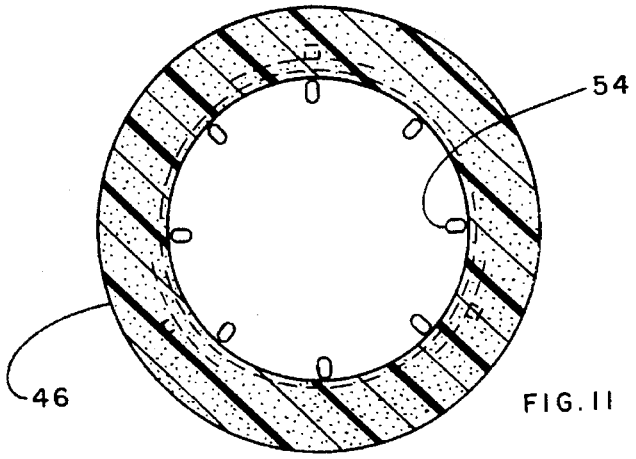
FIG. 11 is a cross-sectional view taken along line 11—11 of FIG. 4.

Referring again to FIG. 4, lid 24 has incorporated therein motor 12 supported upon suitable motor mounting structure 16. Motor mounting structure 16 in combination with lid 24 defines fan plenum chamber 14 having a centrifugal fan 28 therein. Fan plenum chamber 14 is provided with fan inlet eye 18 fluidly communicating with dry chamber 42 of inner tank 22 and fan exit 26 fluidly communicating with the cleaners exhaust port 27. Surrounding the fan eye 18 is a typical filter assembly 17 comprising a filter cage 32 suspended downward from lid 24 in any suitable manner and having a foam filter 30, or any other suitable filtering media, surrounding and cooperating with the filter cage (FIG. 9) so that only filtered air is permitted to enter into fan eye 18. A typical spherical float 34 is confined within filter cage 32 to act as a check valve as described further below.

Referring now to FIGS. 4 7, 10, and 11, the entrance 52 to tower 44 is protected by float valve 50 confined within a typical float cage 48 Float 50 having a density less than water, is intended to rise with the level of fluid collected in wet chamber 40, of outer tank 20, sealing off the entrance 52 of tower 44 when the volumetric capacity of fluid in tank 20 is reached, thereby preventing further wet pickup until tank 20 is, emptied via drain plug 11 (FIGS. 1 and 2). Atop tower 44 is filter cage 54 having a moisture absorbing filter 46 thereabout and cooperating with cage 54 such that all air exiting tower 44 into chamber 42 must pass through filter 46 whereby little or no moisture passes into dry chamber 42.

Having described above the basic structure of vacuum cleaner 10, we now may appreciate its operation by referring to FIGS. 2, 4, and 5. When the user desires to operate the cleaner 10 in the wet pickup mode, valve door 35 is slidingly moved to the right, as illustrated in FIG. 2A, thereby exposing wet inlet port 36. A vacuum hose, with the desired vacuum nozzle (not shown) is inserted into wet inlet port 36 and the motor fan 12, is electrically activated thereby creating a vacuum inside inner tank 22 and outer tank 20 via tower 44. The presence of a vacuum inside cleaner 10 thereby causes valve door 35 to be drawn against the dry inlet port 37, as described above, thereby effectively sealing off dry inlet port 37 from the atmosphere. Following the flow arrows in FIG. 4, moisture laden air enters wet inlet port 36 and is immediately directed downward through bypass 38 into the liquid collection chamber 40 between outer tank 20 and inner tank 22 wherein the water and wet debris is collected and retained. From wet chamber 40 the vacuumed air, minus the suspended moisture and wet debris, passes upward through tower 44, into the dry collection chamber 42 between inner tank 22 and cover 24 exiting therefrom through exhaust port 27 via the filter assembly 17, eye 18 and fan plenum chamber 14. Filter 46 atop tower 44 is preferably a moisture absorbing filter to absorb any remaining moisture in the airflow as it passes therethrough into dry chamber 42.

Tower 44 is empirically sized and proportioned to cause suspended liquid particles in the rising airflow to drop back into wet collection chamber 40.

Similarly when dry vacuuming is desired, valve door 35 is slidingly positioned to the left, as viewed in FIG. 2, thereby sealing off wet inlet port 36 from the atmosphere and exposing dry inlet port 37 for use. Dirt laden air enters the cleaner via dry inlet port 37 directly into dry collection chamber 42 of inner tank 22. Dry debris is thereby collected and retained within tank 22. After depositing its dry debris within inner tank 22, the working air passes through filter 30, into fan plenum 14 and exits the cleaner through exhaust port 27.

As is evident by the above description, vacuum cleaner 10 may be alternately used to pickup wet or dry debris without modification of the cleaner, except for selectively positioning valve door 35. In the event the operator desires to operate cleaner 10 exclusively for wet or conclusively for dry pickup and would like to have the maximum storage capacity of outer tank 20, inner tank 22 may be conveniently removed thereby making available the total capacity of outer tank 20. When the cleaner 10 is exclusively used for wet pickup, with inner tank 22 removed, the ball float check valve 34 of filter assembly 17 provides the function of float 50, by choking the airflow into fan eye 18 when the liquid level rises to its maximum desired level. In the event the user inadvertently uses dry inlet port 37 for wet pickup with inner tank 22 installed, ball check valve 34 also serves to close off fan eye 18 when the liquid capacity of inner tank 22 is reached.

FIG. 12 shows the preferred sealing arrangement between cover lid 24, inner tank 22 and outer tank 20. The peripheral rim 21 of tank 20 comprises an upward opening "U" shaped channel 56 having an inner leg 58 and an outer leg 60 defining a peripheral groove 62 therebetween. Resting upon inner peripheral leg 58 is radially extending flange 19 of inner tank 22. The surface to surface contact between inner leg 58 of outer tank rim 21 and the undersurface of flange 19 forms a first vacuum seal between wet chamber 40 of outer tank 20 and the atmosphere. Alternatively an elastomeric seal may be placed between leg 58 and the under surface of flange 19 or within peripheral groove 62 to assure a perfect seal therebetween. As seen in FIG. 12 outer leg 60 of outer tank rim 21 extends above inner leg 58 engaging the under surface of radially extending peripheral flange 64 of cover lid 24. Preferably flange 64 terminates with a turned down edge 66 which circumferentially overlaps leg 60 of outer tank rim 21 thereby cooperating with leg 60 to properly position lid 24 upon tank 20. The interface contact between leg 60 and the under surface of flange 64 also serves to provide a second vacuum seal between wet chamber 40 and the atmosphere. Positioned between flange 64 of cover 24 and inner tank rim flange 19 is an elastomeric "O" ring seal 68. Preferably "O" ring seal 68 is retained within groove 70 by slightly compressing "O" ring 68 between groove legs 71 and 72. Thus chamber 42 between lid 24 and inner tank 22 is positively sealed off from wet chamber 40 of outer tank 20 and the atmosphere.

The "O" ring seal 68 between cover lid 24 and inner tank 22 is preferred to positively assure that no moisture, from wet chamber 40 of outer tank 20 will leak past the surface to surface seal provided by leg 58 of rim 21 and flange 19 of inner tank 22.

Figure 17:
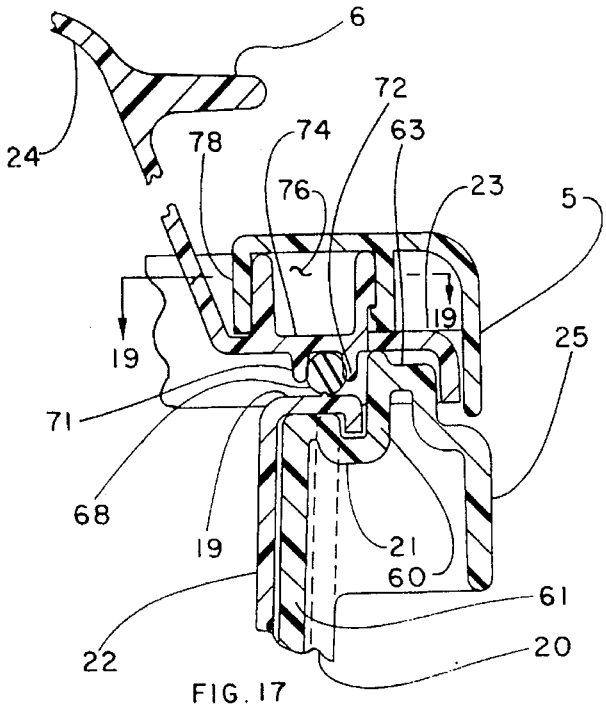
FIG. 17 is a cross-sectional view taken along line 17—17 of FIG. 13.

In the vicinity of outer tank hand holds 25 (see FIGS. 1, 2 and 17) the rim 21 of outer tank 20 and rim 19 of inner tank 22 are modified as shown in FIG. 17 to accommodate hand hold 25 and incorporate the lid to tank latch 5. To provide a lifting hand hold 25 on outer tank 20, tank wall 61 is slightly recessed, as shown in FIG. 17, and a radially extending projection 63 extends from outer leg 60 of outer tank rim 21 terminating with the downwardly extending hand hold 25. Aligned with hand hold 25 of outer tank 20, are lift handles 6, for removing cover 24, molded into the upper profile of lid 24 thereby providing an extended flange surface 74 upon which hollow cylindrical post 76 is integrally molded to rotating receive thereon arcuate latch lever 5.

Figure 18:
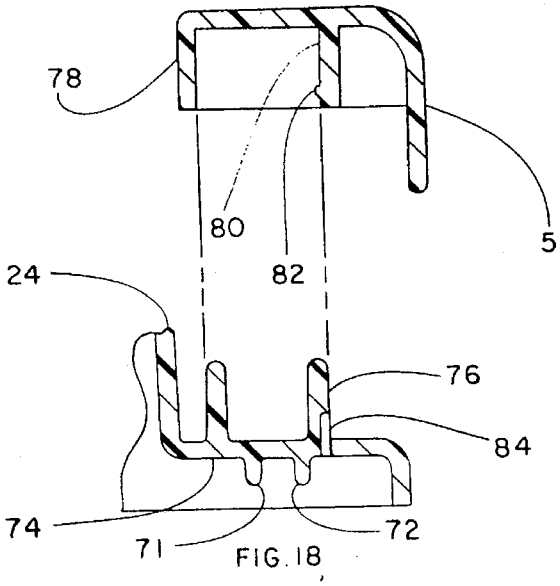
FIG. 18 is a cross-sectional view, similar to FIG. 17 showing the latch arm removed from the latch post.
Figure 19:
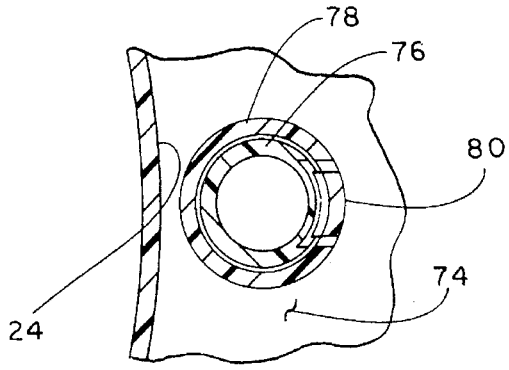
FIG. 19 is a cross-sectional view taken along line 19—19 of FIG. 17.

Referring now to FIGS. 13 through 19, the latching lever assembly and means by which lid 24 is secured to tank 20 will be described. As illustrated in FIGS. 18 and 19 arcuate latch lever 5 includes a hollow cylindrical pivot 78 which telescopingly receives therein hollow post 76. A cylindrical portion of hollow pivot 78 comprises a cantilevered spring 80 having a inwardly directed tab 82 at the free end thereof. Latching lever 5 is attached to hollow post 76 by sliding hollow pivot 78 downward over hollow post 76 until tab 82 snaps into the complimentary circular groove 84 on hollow post 76 thereby locking latch lever 5 upon hollow post 76. Circular groove 84 extends throughout an included angle sufficient to provide the necessary angular movement of latch lever 5 about post 76 to provide latching and unlatching of lid 24 to outer tank 20.

Figure 13:
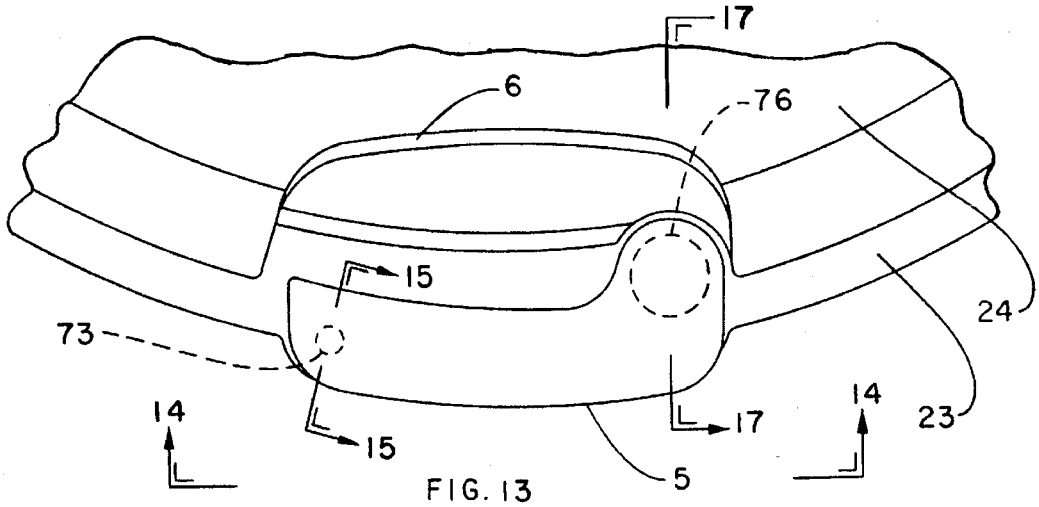
FIG. 13 is a partial and enlarged top view of the lid to tank latch as indicated in FIG. 3.
Figure 14:
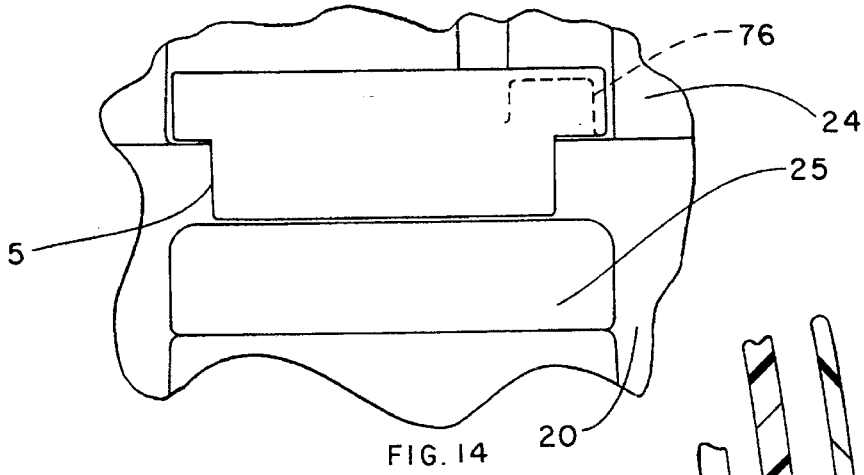
FIG. 14 is a partial elevational view taken long line 14—14 of FIG. 13 showing the vacuum cleaner lid latch.
Figure 15:
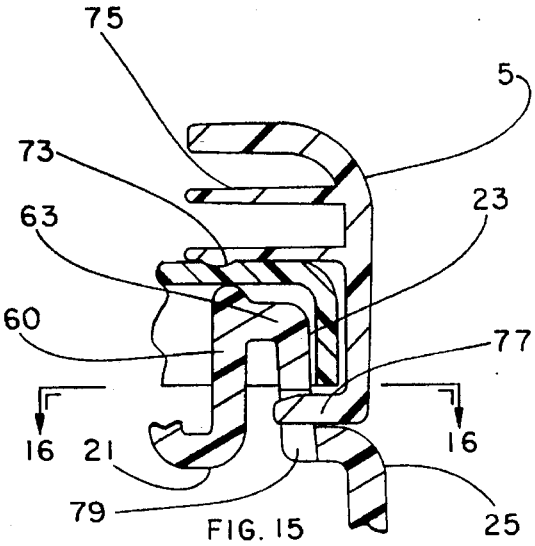
FIG. 15 is a cross-sectional view taken along line 15—15 of FIG. 13.
Figure 16:
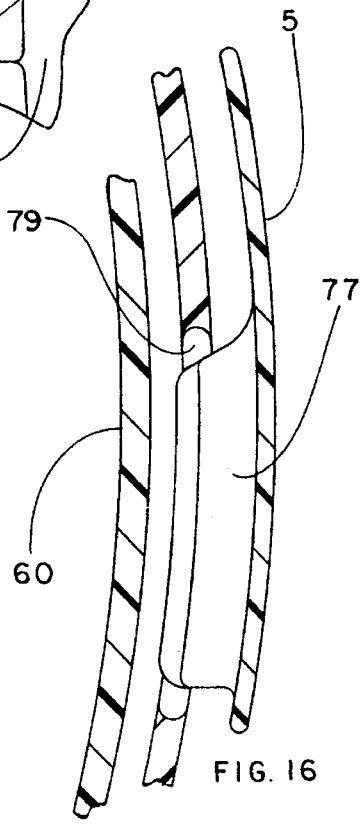
FIG. 16 is a cross-sectional view taken along line 16—16 of FIG. 15.

Latch lever 5 generally follows the peripheral curvature of rim 23 as illustrated in FIG. 13 and includes a radial inwardly extending shoulder 75 and parallel latching tang 77. When in the closed or latched position, as illustrated in FIGS. 13, 17, and 15, shoulder 75 of latch 5 frictionally engages the top horizontal surface of rim 23 and latching flange 77 is received within slot 86 of handle 25 thereby compressing therebetween rim 23 and the radial projection 63 of outer tank rim 21. Thus a vertical clamping force is applied between outer tank rim projection 63 and the underside surface of power head rim 23. Further "O" ring 68 is drawn down upon inner tank rim 19 thereby urging inner tank rim 19 against the rim 21 of outer tank 20. To remove power head 24, arcuate latch 5 is rotated outwardly from the cleaner thereby disengaging shoulder 75 from power head rim 23 and latching flange 77 from slot 79.

To prevent the inadvertent opening of latch 5 when subjected to normal motor vibration during operation of the leaner shoulder 75 of latch lever 5 and rim 23 of power head 24 are preferably provided with an interlocking detent 73 which resists vibrational opening but permits manual disengagement.

As seen in FIGS. 1 through 3 and 20 and 21 the lid or cover is preferably provided with integrally molded vacuum tool accessory storage posts 92 and 94. Storage post 92 comprises a recessed cylindrical groove 90 defining a coaxial post 92 having a diameter approximately sized to frictionally receive thereupon a vacuum accessory tool such as nozzles 88 and 86 as illustrated in FIGS. 1 and 2.

Accessory storage post 94 comprises two recessed, concentric cylindrical grooves 96 and 98 thereby providing frictional storage posts for two different sized vacuum accessories.

Figure 23:
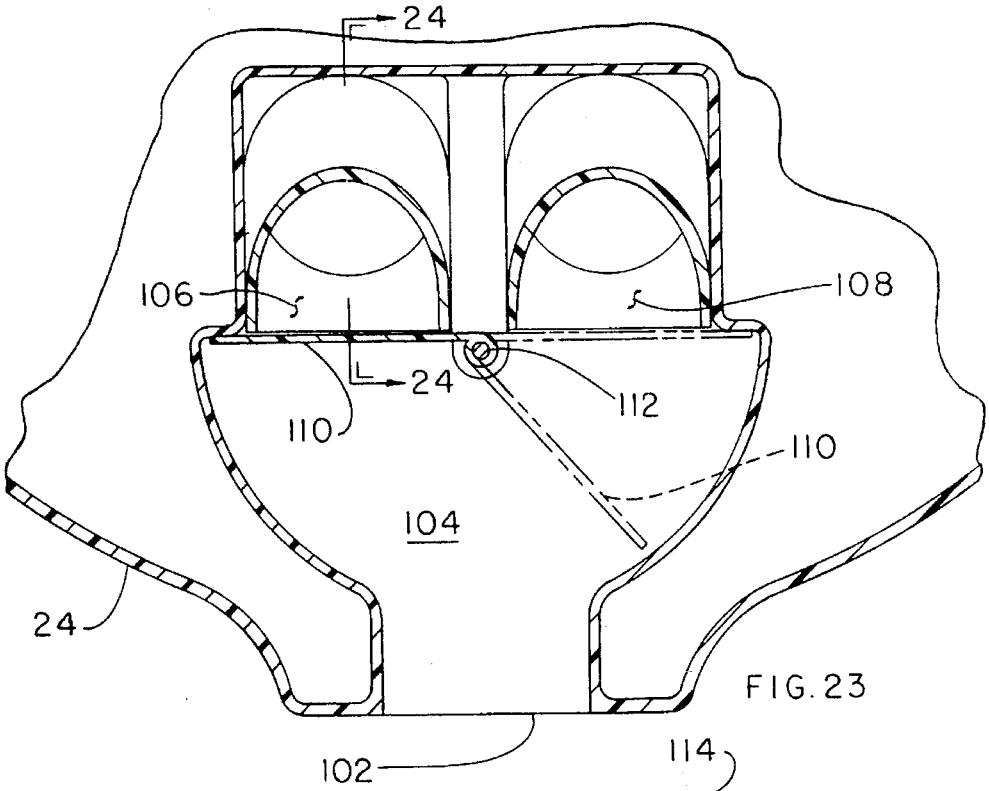
FIG. 23 is a cross-sectional view taken along line 23—23 of FIG. 22 showing an alternate valve door structure for use with the single vacuum inlet port as shown in FIG. 22.
Figure 22:
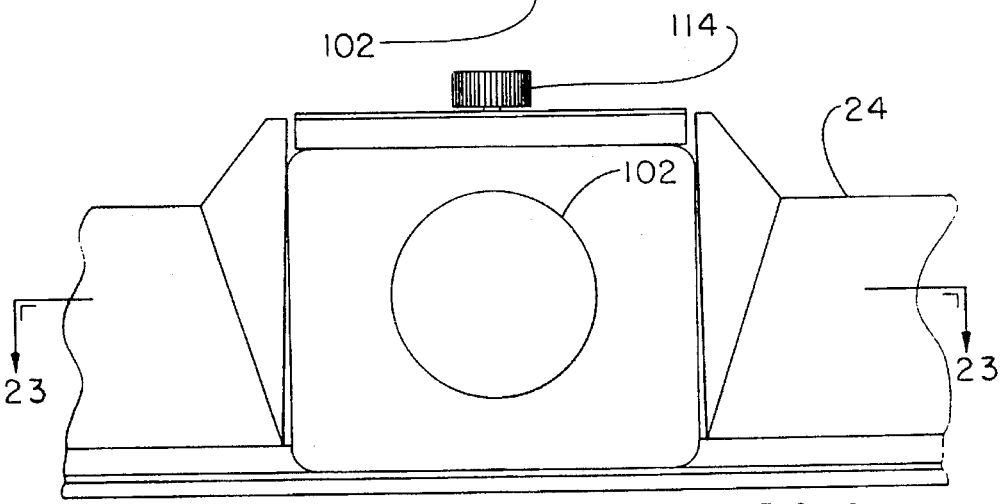
FIG. 22 is a partial front elevation view showing a single inlet vacuum port as an alternate embodiment.
Figure 24:
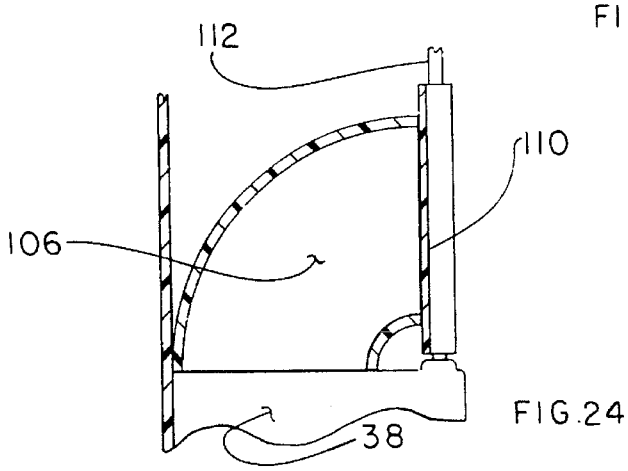
FIG. 24 is a cross-sectional view taken along line 24—24 of FIG. 23.

FIGS. 22 through 24 generally show an alternate embodiment wherein a single inlet port 102 is provided for insertion of a vacuum hose (not shown) thereby eliminating the need for the user to physically move the vacuum hose between the wet and dry inlet ports as is necessary in the above described preferred embodiment. Inlet port 102 fluidly communicates with manifold 104 which in turn has wet and dry inlet ports 106 and 108 respectively exiting therefrom. Inlet ports 106 and 108 function as inlet ports 36 and 37, respectively, as discussed above. Valve door 110 rotates about pivot shaft 112 by hand operation of knob 114 by the user to selectively choose wet or dry operation. When dry material is to be vacuumed, the operator, rotates knob 114 clockwise thereby causing valve door 110 to close off wet inlet port 106 from manifold 104 and open dry inlet port 108 so as to receive dry debris entering manifold 104 via inlet port 102. Similarly when the operator desires to vacuum wet debris, wet inlet port 106 is opened and dry inlet port 108 is closed off and sealed from manifold 104 by rotating knob 114 counterclockwise. Wet and dry inlet ports 106 and 108 are configured within power head 24 to replace inlet ports 36 and 37 so as to fluidly communicate with wet bypass 38 and inner tank 22 (as shown in FIG. 5).

Although the invention has been described in detail with reference to the illustrated preferred embodiment, variations and modifications exist within the scope and spirit of the invention as described and as defined in the following claims.

We claim:

1. A tank type vacuum cleaner comprising:

a) a first tank having a removable cover sealingly attached, b) a second tank positioned within said first tank, said second tank displacing a portion of the internal volume of said first tank, c) sealing means between said first and second tanks, d) fan means for drawing air from said second tank thereby reducing the pressure therein below atmospheric, e) a first conduit means fluidly communicating with said first tank, f) a second conduit means fluidly communicating with said second tank, g) a vacuum inlet port fluidly communicating with said first and second conduit means, h) means for selectively closing said first or second conduit means whereby fluid communication between said inlet port and said first or second tank is thereby interrupted, i) seal bypass means providing fluid communication between said first and second tanks whereby debris laden air when entering said first inlet means passes into said first tank, depositing said debris therein, and enters said second tank through said seal bypass means, and exiting therefrom into said fan means.

2. The vacuum cleaner as claimed in claim 1 wherein said first and second vacuum inlet means and said fan means are embodied within said cover.

3. The vacuum cleaner of claim 1 wherein said second tank is telescopingly received within said first tank thereby forming an upper and lower debris collecting chamber.

4. The vacuum cleaner of claim 3 wherein said second tank includes an integral inlet bypass means fluidly communicating with said first inlet means whereby said first inlet means is in fluid communication with said lower debris collecting chamber through said inlet bypass means.

5. The vacuum cleaner of claim 4 wherein said second tank further includes integral thereto, said seal bypass means whereby said lower debris collecting chamber fluidly communicates with said upper debris collecting chamber.

6. The vacuum cleaner of claim 5 wherein the exit end of said seal bypass means includes filter means whereby all working air passing from said first tank means into said second tank, through said exhaust bypass means, passes through said filter means.

7. The vacuum cleaner as claimed in claim 6 wherein said exhaust bypass means includes valve means whereby said exhaust bypass means is closed when the liquid level within said first tank reaches a predetermined level thereby preventing passage of working air from said first tank into said second tank.

8. The vacuum cleaner as claimed in claim 3 wherein said second tank is removable.

9. The vacuum cleaner as claimed in claim 8 wherein said fan means includes an inlet fluidly communicating with said second tank, and an outlet fluidly communicating with the atmosphere, said inlet including filter means whereby all working air passing through said fan means first passes through said filter means.

10. The vacuum cleaner as claimed in claim 1 including sealing means between said removable cover and said second tank.

11. The vacuum cleaner as claimed in claim 10 wherein the sealing means between the removable cover and said second tank comprises an elastomeric "O" ring.

12. A tank type vacuum cleaner comprising:

a) a hollow main body housing b) separation means for dividing said hollow body housing into first and second debris receiving chambers, said separation means including removable cover means cooperating with said main body housing for sealing said first and second chambers from one another and from the atmosphere, c. inlet port means for receiving vacuumed debris therethrough, d. means for selectively directing said vacuumed debris to said first or second debris receiving chamber, e. air evacuation means for withdrawing working air from said first and second debris receiving chambers thereby creating a vacuum therein.

13. The vacuum cleaner as claimed in claim 12 wherein said air evacuation means includes a fan positioned in said cover.

14. A vacuum cleaner comprising:

a. first and second debris receiving chambers, said second chamber selectively positioned within said first chamber, said second chamber being selectively removable to increase the capacity of the first chamber.

b. debris receiving inlet means for receiving vacuumed debris therethrough, said inlet means including means for selectively directing said vacuumed debris into said first or second chamber, c. means for withdrawing working air from said first and second chambers.

15. The vacuum cleaner as claimed in claim 14 further comprising fluid bypass means between said first and second chambers for fluidly connecting said first and second chambers.

16. A vacuum cleaner comprising:

a. two at least debris receiving chambers;

b. debris receiving inlet means for receiving vacuumed debris therethrough, said inlet means including means for selectively directing said vacuumed debris into a selected debris receiving chamber;

c. means for withdrawing working air from said selected chamber; said working air first passing through a first debris receiving chamber when said first chamber is said selected chamber where liquid entrained in said working air is removed and then passing through a second debris receiving chamber where solid debris entered in said working air is removed by a filter such that said filter does not contact liquid, said working air passing through only said second debris receiving chamber when said second debris receiving chamber is said selected chamber.

17. A tank type vacuum cleaner comprising:

a. a first tank having a removable cover sealingly attached;

b. a second tank positioned within said first tank, said second tank displacing a portion of the internal volume of said first tank;

c. sealing means between said first and second tanks; said sealing means comprising a first seal and a second seal;

d. fan means for drawing air from said second tank thereby reducing the pressure therein below atmospheric.

18. A tank type vacuum cleaner comprising:

a) a first main body tank;

b) a second tank positioned within said first tank;

c) fan means for drawing air into said vacuum cleaner and depositing air entrained debris into a selected one of said first or second tanks;

d) a first vacuum inlet port fluidly communicating with said first tank;

e) a second vacuum inlet port fluidly communicating with said second tank;

f) means for selectively directing debris into either said first tank via said first inlet port or into said second tank via said second inlet port.

19. A utility vacuum cleaner comprising:

a. a first and second debris receiving tanks, said second tank positioned within said first tank;

b. suction means for withdrawing air from said first and second tanks;

c. first and second means for conveying air-entrained debris into the respective tank;

d. means for selectively closing one of said first or second means for conveying air-entrained debris thereby interrupting the flow of debris to the respective tank.

20. A utility vacuum cleaner comprising:

a. two separate debris receiving tanks;

b. a removable cover sealingly attached to said tanks; at least one pivotal latch carried by said cover, said latch configured to engage one of said tanks and provide a clamping force between said cover and said tanks;

c. suction means, within said cover, for withdrawing air from said tanks;

d. inlet means located in said removable cover for directing debris laden air into the selected tank;

e. valve means operable for selecting one of said tanks for receiving said debris.

21. A vacuum cleaner according to claim 14 further comprising a check valve fluidly disposed between said means for withdrawing working air from said first and second chambers and both of said first and second chambers such that said check valve protects said means for withdrawing when one of said chambers fills with liquid.

22. A utility vacuum cleaner according to claim 20, where said at least one latch provide a hand hold for lifting the vacuum cleaner.

23. A vacuum cleaner according to claim 17 further comprising an O-ring disposed between each of said tanks and the atmosphere.

* * * * *